US005479075A

United States Patent [19]

Chen

[11] Patent Number: 5,479,075

[45] Date of Patent: Dec. 26, 1995

[54] FLUORESCENT LAMP STARTER CIRCUIT

[76] Inventor: Shih-Ta Chen, 3Fl., No. 33-1, Tien Mei 3rd St., Hsin Chu City, Taiwan

[21] Appl. No.: 383,387

[22] Filed: Feb. 3, 1995

[51] Int. Cl.[6] ..... H05B 41/16

[52] U.S. Cl. ..... 315/283; 315/244; 315/105; 315/100; 315/94; 315/107

[58] Field of Search ..... 315/283, 290, 315/244, 238, 106, 105, 104, 102, 101, 100, 94, DIG. 5, 107, 73, 74, 75

[56] References Cited

U.S. PATENT DOCUMENTS

| | | | |
|---|---|---|---|
| 3,476,976 | 11/1969 | Morita et al. | 315/101 |
| 3,760,224 | 9/1973 | Shimizu et al. | 315/101 X |
| 3,851,209 | 11/1974 | Murakami et al. | 315/101 X |
| 3,857,060 | 12/1974 | Chermin | 315/DIG. 5 X |
| 4,350,929 | 9/1982 | Katoogi | 315/DIG. 5 X |

*Primary Examiner*—Robert J. Pascal
*Assistant Examiner*—Haissa Philogene
*Attorney, Agent, or Firm*—Pro-Techtor International

[57] ABSTRACT

A fluorescent lamp starter circuit includes a relay which forms a first circuit loop to detect the input voltage and to switch the relay from the normally-closed position to the normally-open position once the input voltage reaches the threshold level. The switching of the relay to the normally-open position opens the first circuit loop and closes a second circuit loop constituted partly by the relay to allow current to flow through and heat up the electrodes of the fluorescent lamp. After a certain time period, the relay, which is controlled by the discharging of a capacitor, is switched back to the normally-closed position to open the second circuit loop. The electrodes of the fluorescent lamp, after having been heated, begins to emit electrons and this lowers down the impedance that it represents so that the voltage across the first circuit loop is not sufficient to actuate the relay so as to maintain the relay at the normally-closed position.

10 Claims, 7 Drawing Sheets

FLUORESCENT LAMP STARTER CIRCUIT

FIELD OF THE INVENTION

The present invention relates to a fluorescent lamp and in particular to a fluorescent lamp starter circuit which provides a faster, more stable, no flashing and longer service life fluorescent lamp starter.

BACKGROUND OF THE INVENTION

A fluorescent lamp device generally comprises a fluorescent tube socket, a starter and a ballast. The fluorescent lamp starters has two different types which are respectively shown in FIGS. 1 and 2 of the attached drawings. In FIG. 1, the starter comprises a hermetic casing 11 inside which an inert gas, such as argon and neon, is filled. Two conductive elements 12 and 13 are mounted inside the casing. One of the conductive elements, represented by the reference numeral 12, is made of a bi-metal material which, when heated, undergoes deformation so as to be in physical contact with the other conductive element 13. In operation, the two conductive elements 12 and 13 are not in contact initially and once a voltage is applied to the two conductive elements 12 and 13, a glow discharge through the inert gas inside the casing 11 occurs. By the glow discharge, the conductive element 12 is heated and gradually deformed to contact the element 13. This establishes a closed circuit loop through a fluorescent lamp.

In FIG. 2, another type of fluorescent lamp starter is shown, wherein a capacitor of approximately 0.006 μF, indicated by the reference numeral 14, is connected in parallel with the starter. The starter has a structure similar to that shown in FIG. 1, namely having a hermetic casing 11 inside which an inert gas is filled and two conductive elements 12 and 13 secured inside the casing 11 and in parallel electrical connection with the capacitor 14.

The starters may also be classified as 1P (for 10 W and 20 W fluorescent lamps) and 4P (for 40 W fluorescent lamp) which are respectively used in combination with two different ballasts respectively shown in FIGS. 3 and 4, in which S indicates starter, 18 fluorescent lamp and 19 ballast.

In FIG. 5, a more detailed diagram of the fluorescent lamp circuit of FIG. 4 is shown. When a voltage is applied on the terminals A' and B', an electrical potential is established between the elements 12 and 13 of the starter S, causing a glow discharge. After a 1 to 2 second time elapse, due to temperature raise caused by the glow discharge, the element 12 is deformed to contact the element 13, forming a closed circuit loop. This causes a current flowing through the electrodes 16 and 17 of the fluorescent lamp 18 to heat up the electrodes 16 and 17. Thereafter, the self-induced high voltage provided by the ballast 15 drives the electrons emitted from one of the heated electrodes 16 and 17 to move through the inert gas inside the fluorescent lamp 18 to reach the other electrode, forming a closed current loop, which includes the ballast 15, the electrode 16, the inert gas inside the fluorescent lamp 18 and the electrode 17. By this way, the free electrons impact the coated inside surface of the fluorescent tube and the inert gas and emit light.

Once the closed loop forming partly by the free electrons moving through the fluorescent lamp 18 is established, glow discharge no longer occurs inside the starter S. The bi-metal element 12 thus cools down and disengages from the fixed element 13.

Such a conventional circuit structure of the fluorescent lamps although having been used for quite some time has several disadvantages, such as:

(1) To allow the two conductive elements 12 and 13 to contact each other, it takes time to heat up the elements 12 and 13 and thus the lighting of the fluorescent lamp 18 is slow.

(2) The heating of the bi-metal element 12 of the conventional starters consumes energy.

(3) The reliability of the bi-metal switch of the conventional starters may be affected by external temperature and may malfunction due to metal fatigue.

(4) The switching of the bi-metal starter requires a minimum rating voltage to trigger the switching so that it does not work for voltage lower than the rating level.

It is therefore to provide a novel fluorescent lamp starter structure which overcomes the above-mentioned drawbacks of the conventional starters.

SUMMARY OF THE INVENTION

It is an object of the present invention to provide a fluorescent lamp starter structure which starts up the fluorescent lamp in electronic fashion so as to speed up the lighting of the lamp and eliminate the flashing generated by the conventional starters.

It is another object of the present invention to provide a fluorescent lamp starter structure which eliminates the bi-metal elements and instead, makes use of the charging and discharging of capacitors to light up the fluorescent lamp so as to reduce energy wasted in heating up the bi-metal element.

It is a further object of the present invention to provide a fluorescent lamp starter structure which is capable to start up a fluorescent lamp of a 110 V electrical system with a rating starting voltage as low as 90 V so as to light a fluorescent lamp with a lower voltage.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENTS

Figure 1:
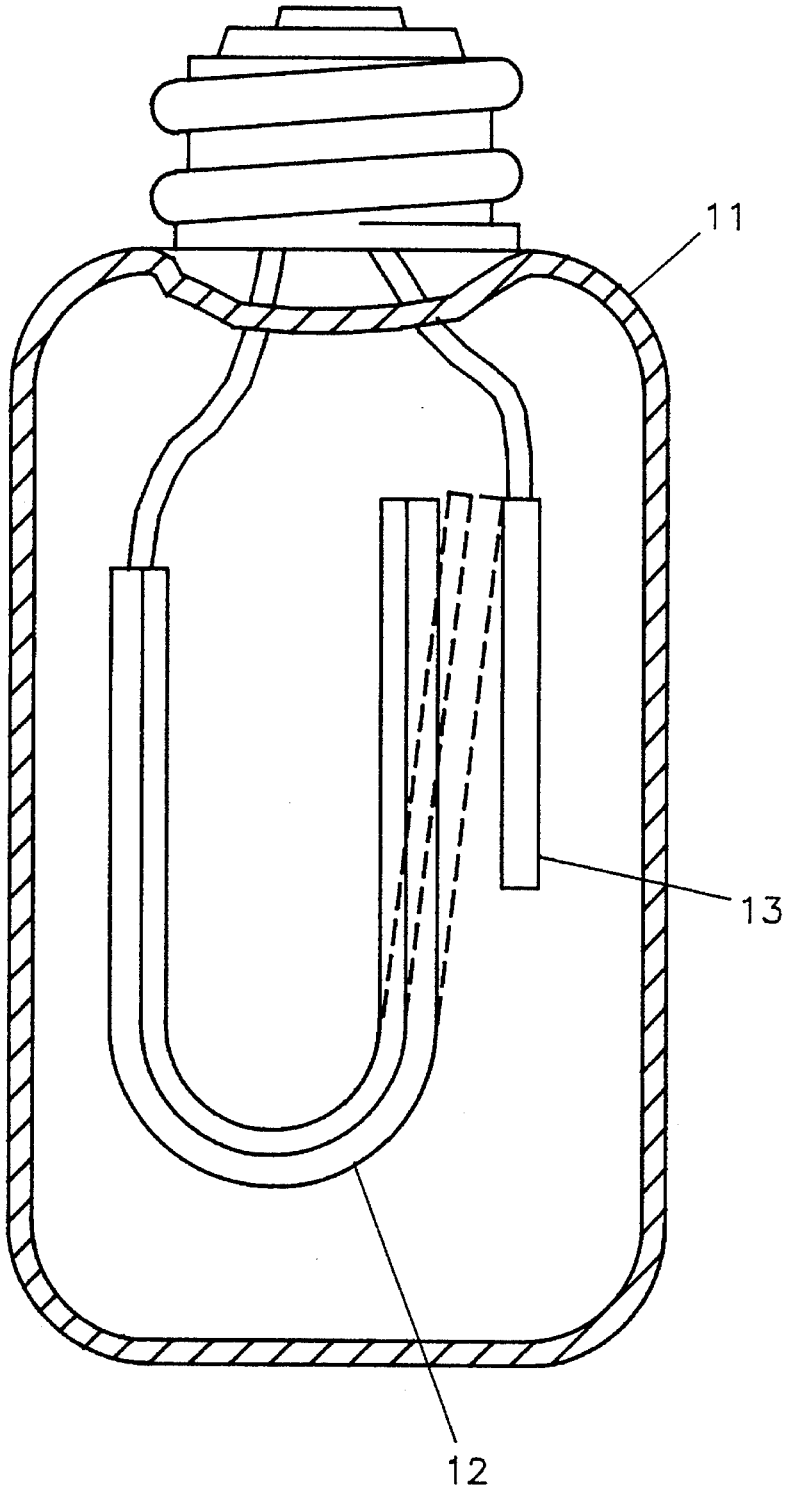
FIG. 1 PRIOR ART
FIGS. 1 and 2 respectively show two different prior art fluorescent lamp starter structures.
Figure 2:
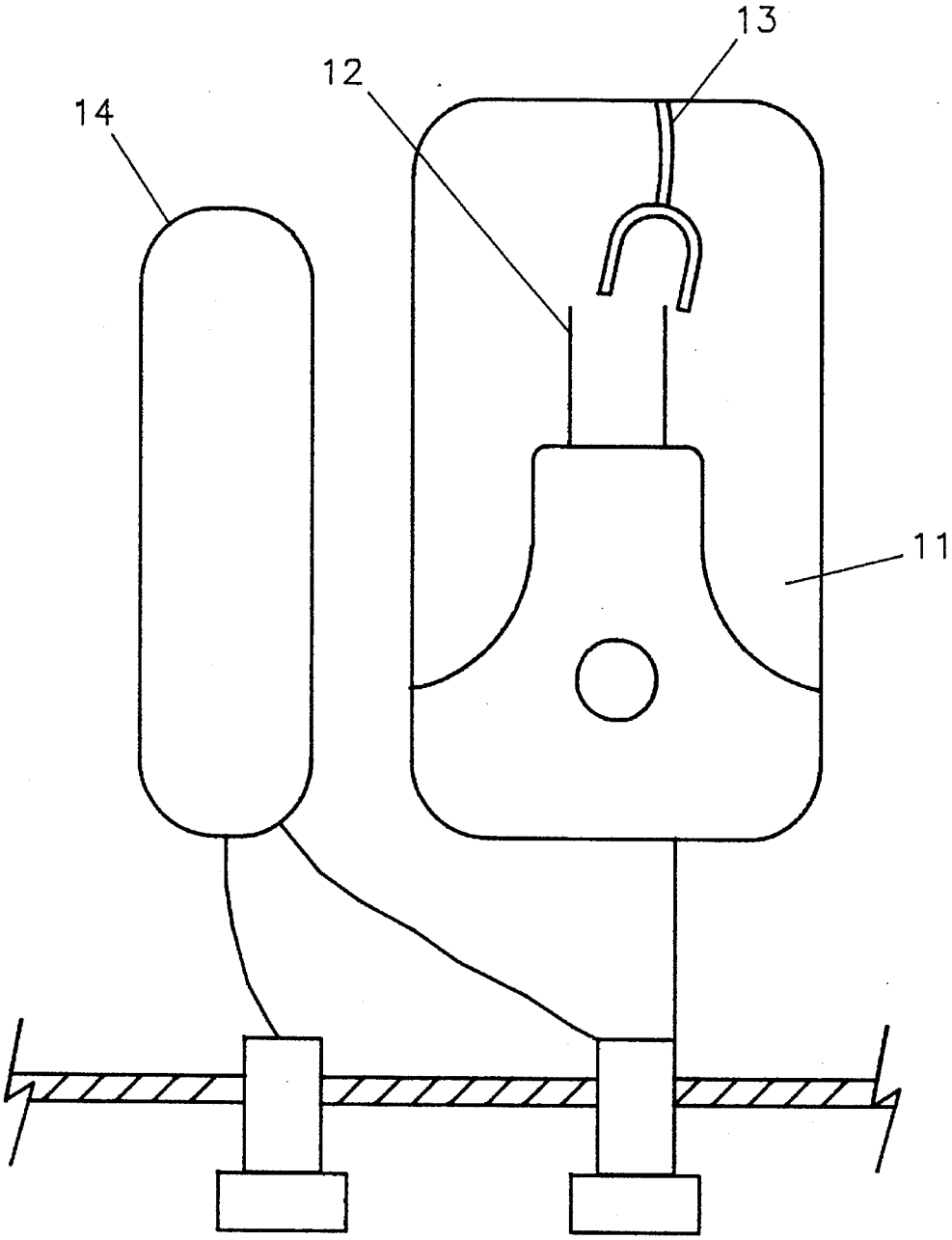
FIG. 2 PRIOR ART
Figure 3:
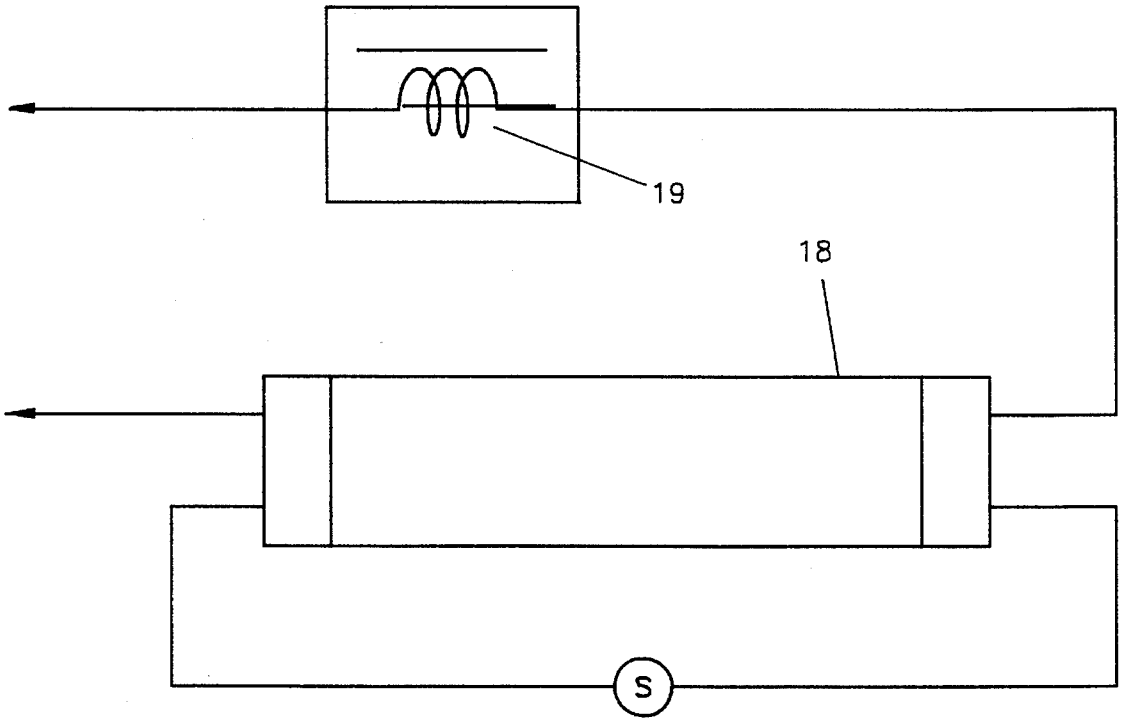
FIG. 3 PRIOR ART
FIGS. 3 and 4 respectively show two different connections of the starter and ballast with the fluorescent lamp.
Figure 4:
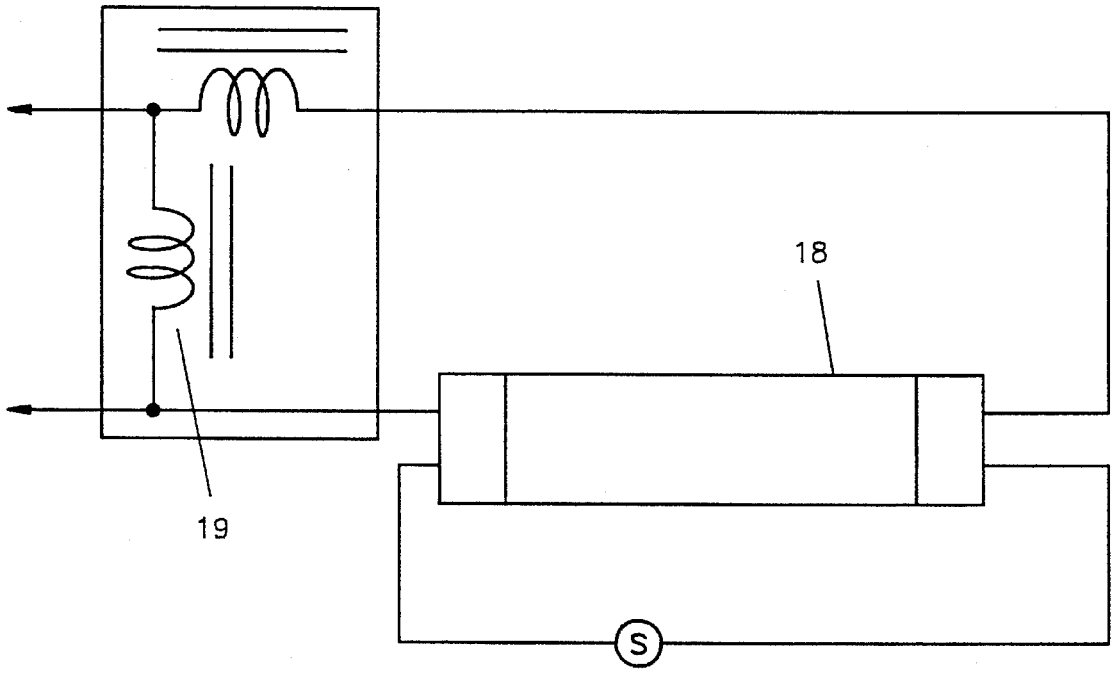
FIG. 4 PRIOR ART
Figure 5:
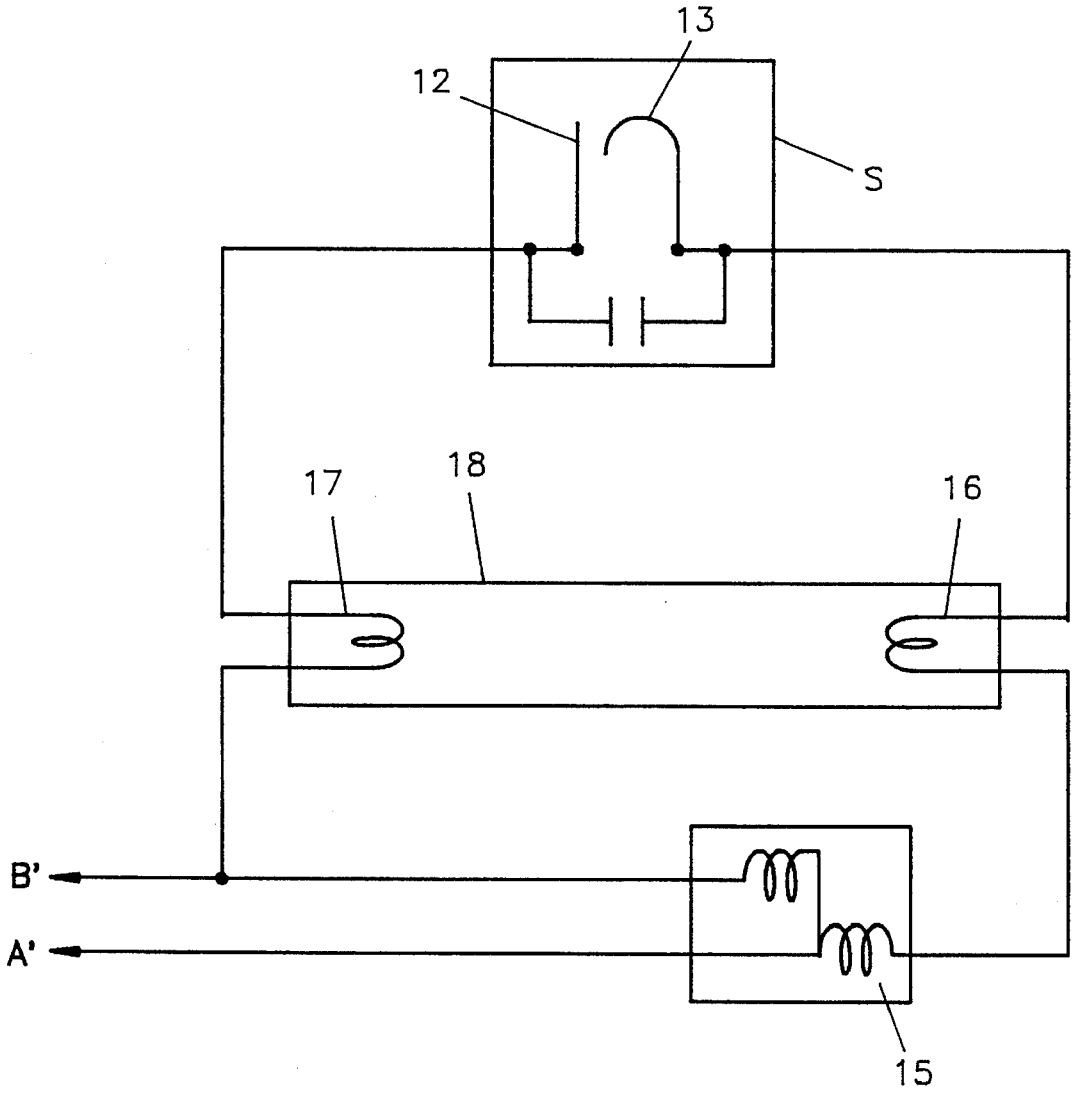
FIG. 5 PRIOR ART
FIG. 5 shows a more detailed circuit diagram of FIG. 4.
Figure 6:
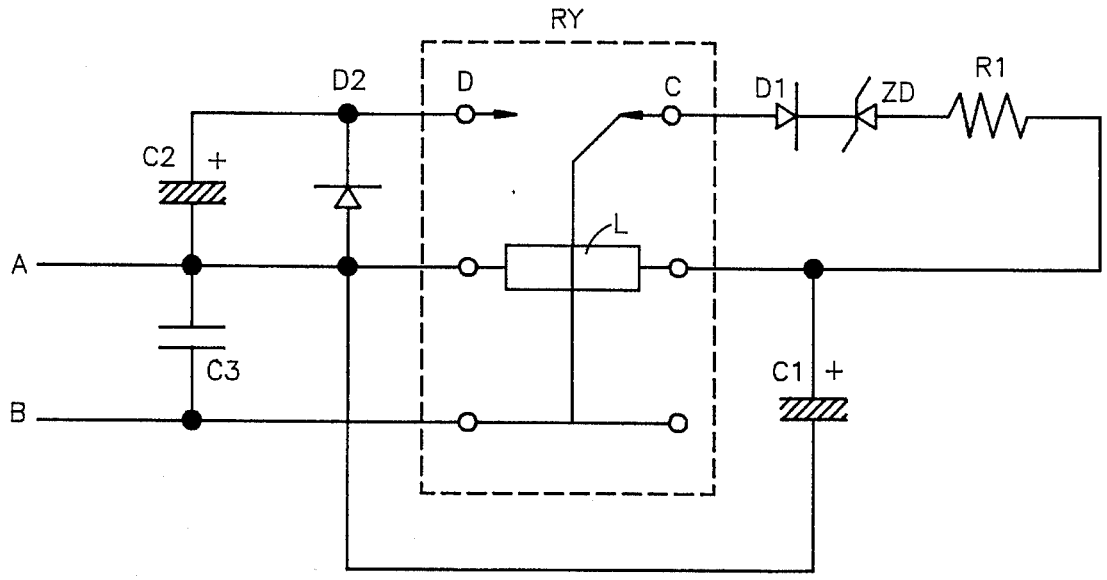
FIG. 6 shows a circuit diagram of a fluorescent lamp starter circuit in accordance with the present invention.

With reference to the drawings and in particular to FIG. 6 wherein a circuit diagram of a fluorescent lamp starter, designated with the reference S in accordance with a first embodiment of the present invention is shown, in the embodiment illustrated, the starter circuit S comprises a relay RY of which two external terminals A and B are respectively connected to the two electrodes 16 and 17 of the fluorescent lamp 18 (see FIGS. 3, 4 and 5) and thus in connection with an external alternating power source to be driven thereby.

The relay RY has a normally-closed contact C and a normally-open contact D, each of which forms a circuit. The first circuit loop begins at the normally-closed contact C, having a first diode D1, a Zener diode ZD and a resistor R1 connected in series. The resistor R1 is connected to coil L of the relay RY. By this arrangement, once the starter S is switched on, a voltage that is higher than the breakdown voltage of the Zener diode ZD, which is for example 10–180 V, is applied to the two terminals A and B to cause a current flowing through the first circuit loop, energizing the coil L to move the relay RY from the normally-closed contact C to the normally-open contact D. This opens the first circuit loop.

Preferably, a first capacitor C1, having a capacity of for example 1–300 μF, is connected in parallel with the coil L of the relay RY so as to delay the actuation of the coil L. Under this condition, the first capacitor C1 should be charged first to a certain level before the relay L can be actuated.

The second circuit loop associated with the relay RY begins with the normally-open contact D with a second capacitor C2 connected between the normally-open contact D and the terminal B. A second diode D2 is connected in parallel with the second capacitor C2 for protection purpose. The second capacitor C2 may have a capacity of for example 1–47 μF.

The switching of the relay RY from the normally-closed contact C to the normally-open contact D allows the current flowing through the relay RY to heat up the electrodes 16 and 17 of the fluorescent lamp 18. Once the relay RY is switched to the normally-open contact D, the first capacitor C1 begins to discharge which will eventually cause the relay RY to switch back to the normally-closed contact C.

In summary, at the moment when the fluorescent lamp 18 is just turned on, the external power is first supplied to the starter S and the current flows through the first circuit loop due to the fact that the electrodes 16 and 17 of the fluorescent lamp 18 are not ready to emit electrons, the current flowing through the first circuit charges the first capacitor C1 and then energizes and actuate the coil L. Please note that the relay RY is in the normally-closed position at this moment. The actuation of the coil L causes the relay RY to switch from the normally-closed contact C to the normally-open contact D. The relay RY is maintained at the normally-open position by the first capacitor C1 which discharges gradually. The switch of the relay RY closes the second circuit loop, through which current is allowed to charge the capacitor C2 and heat up the electrodes 16 and 17 of the fluorescent lamp 18. After the first capacitor C1 discharges to certain level, at which time the electrodes 16 and 17 of the fluorescent lamp 18 is heated enough to emit electrons, the relay RY moves back to the normally-closed position. This breaks the second circuit loop and thus allows current to flows through the fluorescent tube due to the emission of electrons between the two electrodes 16 and 17 of the fluorescent lamp 18.

It should be noted that when the relay RY moves back to the normally-closed position, since the emission of electrons between the electrodes 16 and 17 of the fluorescent lamp 18 provides a lower impedance which does not establish a high enough voltage to break down the Zener diode ZD of the first circuit loop. In this case, both the first and second circuit loops are open loops.

Preferably a third capacitor C3 is connected between the two terminals A and B of the relay RY to suppress the high frequency impulses generated during the lamp 18 is just turned on.

Figure 7:
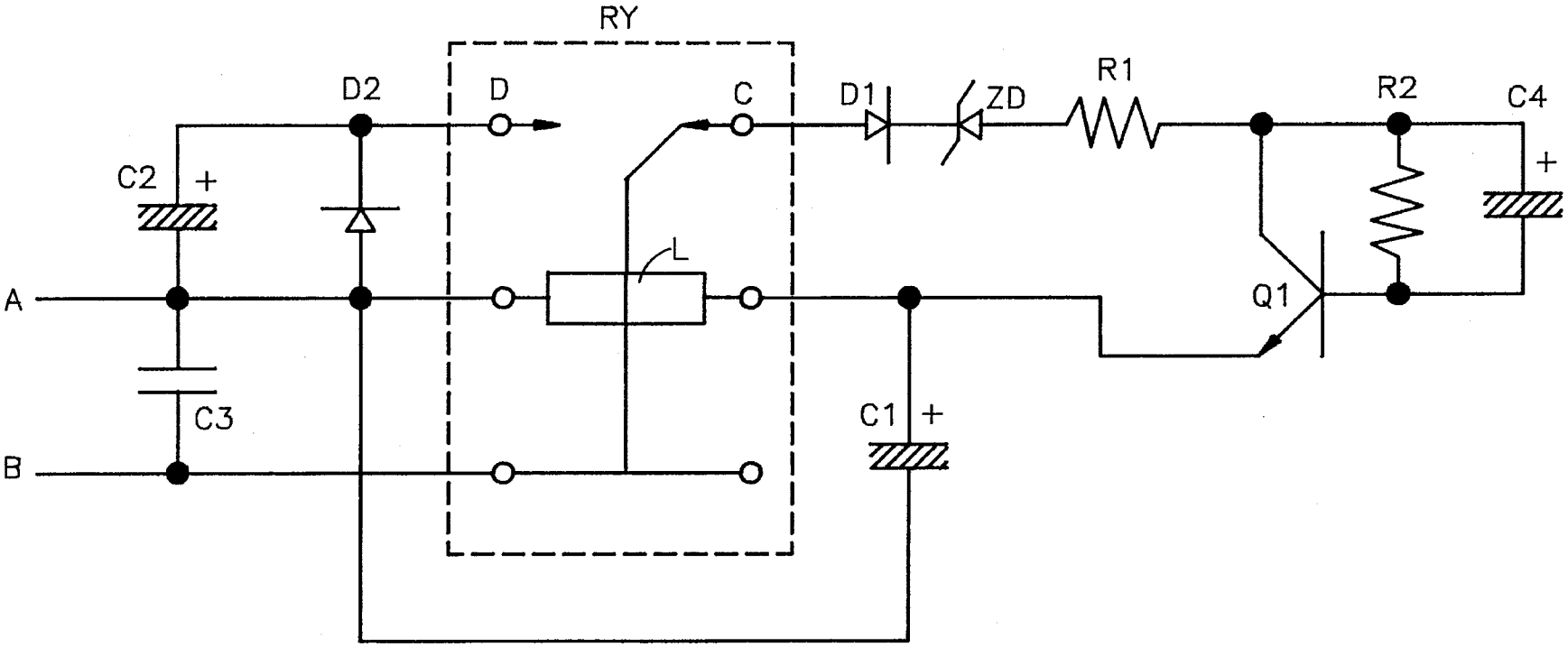
FIG. 7 shows a circuit diagram of another fluorescent lamp starter circuit in accordance with the present invention.

In FIG. 7, a second embodiment of the present invention is shown, which is similar to the first embodiment shown in FIG. 6, except a transistor Q1 is connected between the resistor R1 and the coil L of the relay RY/the first capacitor C1. A second resistor R2 and a fourth capacitor C4 are connected in parallel between the base and the collector of the transistor Q1. The second resistor R2 and the fourth capacitor C4 together provide a bias for turning on the transistor Q1. The turning-on of the transistor Q1 allows the first capacitor C1 to be charged. The provision of the fourth capacitor C4 delays the turning-on of the transistor Q1 which in turn delays the charging of the first capacitor C1. This may reduce the frequency of switching forth and back of the relay RY so as to offer a protection to the circuit.

Changes and modifications in the specifically described embodiments, such as eliminating the second capacitor C2 from the second circuit loop or eliminating both the second capacitor C2 and the second diode D2 from the second circuit loop and thus making the second circuit loop a short circuit between the normally-open contact D and the external terminal B, can be carried out without departing from the scope of the invention which is intended to be limited only by the scope of the appended claims.

What is claimed is:

1. A fluorescent lamp starter circuit comprising a relay switchable between a normally-open position having a normally-open contact associated therewith and a normally-closed position having a normally-closed contact associated therewith and a coil actuateable to switch the relay from the normally-closed position to the normally-open position, the relay further comprising two external terminals respectively connected to two electrodes of a fluorescent lamp to receive an external voltage therebetween, one of the external terminals being in connection with the coil and the other external terminal being selectively contactable with one of the normally-closed contact and the normally-open contact in response to the actuation of the relay; first circuit means connected between the normally-closed contact of the relay and the coil to allow the external voltage applied thereto to actuate the coil for moving the relay from the normally-closed position to the normally-open position, the first circuit means further comprising a capacitor connected in parallel with the coil which is charged by the external voltage; and second circuit means connected between the normally-open contact of the relay and the one of the external terminals that is in connection with the coil to allow current to flow through and heat up the electrodes of the fluorescent lamp.

2. The fluorescent lamp starter circuit as claimed in claim 1, wherein the first circuit means comprises a diode, a Zener diode and a resistor connected in series.

3. The fluorescent lamp starter circuit as claimed in claim 2, wherein the first circuit further comprises a transistor connected between the resistor and the coil, a further resistor and a further capacitor being connected in parallel between the collector and the base of the transistor.

4. The fluorescent lamp starter circuit as claimed in claim 1, wherein the second circuit comprises a capacitor and a diode connected in parallel between the normally-open contact of the relay and the one of the external terminals that is in connection with the coil.

5. The fluorescent lamp starter circuit as claimed in claim 1, wherein the second circuit comprises and a diode connected between the normally-open contact of the relay and the one of the external terminals that is in connection with the coil.

6. The fluorescent lamp starter circuit as claimed in claim 1, wherein the second circuit comprises a short circuit between the normally-open contact of the relay and the one of the external terminals that is in connection with the coil.

7. The fluorescent lamp starter circuit as claimed in claim 1, further comprising a capacitor connected between the two external terminals of the relay.

8. The fluorescent lamp starter circuit as claimed in claim 2, wherein the Zener diode of the first circuit has a breakdown voltage of 10–180 V.

9. The fluorescent lamp starter circuit as claimed in claim 2, wherein the capacitor of the first circuit has a capacity of 1–300 μF.

10. The fluorescent lamp starter circuit as claimed in claim 4, wherein the capacitor of the second circuit has a capacity of 1–47 μF.

* * * * *